United States Patent [19]

Miyauchi et al.

[11] 4,415,627

[45] Nov. 15, 1983

[54] CHEMICALLY RESISTANT THERMOSENSITIVE RECORDING PAPER

[75] Inventors: Masahiro Miyauchi, Tokyo; Sadao Morishita, Ibaraki; Fumio Okumura, Kunitachi; Masahiro Higuchi, Tokyo, all of Japan

[73] Assignee: Mitsubishi Paper Mills, Ltd., Tokyo, Japan

[21] Appl. No.: 333,779

[22] Filed: Dec. 23, 1981

[30] Foreign Application Priority Data

Dec. 23, 1980 [JP] Japan ..... 55-182557
Jan. 7, 1981 [JP] Japan ..... 56-981

[51] Int. Cl.[3] ..... B41M 5/18

[52] U.S. Cl. ..... 428/332; 282/27.5; 427/152; 428/320.4; 428/336; 428/478.8; 428/488; 428/537; 428/913

[58] Field of Search ..... 427/150–152; 428/488, 537, 913, 320.4, 320.6, 320.8, 332, 336, 478.8, 498; 282/27.5

[56] References Cited

U.S. PATENT DOCUMENTS 4,168,845 9/1979 Oeda ..... 428/913

FOREIGN PATENT DOCUMENTS 53-81570 6/1978 Japan .
56-24192 3/1981 Japan ..... 282/27.5

*Primary Examiner*—Bruce H. Hess
*Attorney, Agent, or Firm*—Cushman, Darby & Cushman

[57] ABSTRACT

A thermosensitive recording paper consisting of a dye precursor and a color developer capable of coloring said dye precursor on heating, wherein one type of overcoat layer selected from the group consisting of alginates, alumina sol, colloidal silica and a mixture of alumina sol with colloidal silica is provided as the topmost layer thereof to give improved chemical resistance and good printing quality with a reduced deterioration in sensitivity and no residues and sticking.

4 Claims, No Drawings

CHEMICALLY RESISTANT THERMOSENSITIVE RECORDING PAPER

This invention relates to a thermosensitive recording paper, and more particularly to a thermosensitive recording paper with a reduced deterioration of white and colored parts by chemicals.

Thermosensitive recording paper is prepared by the following processes:

(1) Carbon or a colored dye or pigment is applied to a substrate, and then an opaque thermoplastic material is applied to the substrate on which carbon or the dye or pigment was applied. The opaque layer is then made transparent by heat to form an image due to the colored layer of the underlayer.

(2) A complex compound of an electron donor with an electron acceptor is formed by heat.

(3) A dye precursor such as Crystal Violet lactone and an acidic color developer such as a phenolic compound are discontinuously dispersed, and the dispersion is applied to a substrate and heated to dissolve one or both of the dye precursor and the developer, and develop color.

Among the processes, the process (3) is used for general facsimile and printers because of sharp images, improved resolving power and color tone of images and slight residues.

As for the properties required for such types of thermosensitive recording paper, there are listed white background, colored images stable and unfaded for a long term, no formation of residues on recording, no sticking to a hot head on recording as well as sensitivity provided according to various uses and the like. Various thermosensitive recording papers satisfying many requirements has been manufactured; however, they have low preservation (hereinafter referred to as chemical resistance) of image parts by chemicals such as a plasticizer, alcohol, acetone, bezene or xylene. In view of practical aspect, it is disadvantageous that letters are not easily decipherable due to decolorization in contact with an eraser or a bag made of vinyl chloride resin containing a large amount of a plasticizer, or a hand smeared with a hand cream or hairdressing oil. These phenomena are based on the fact that a color forming lactone of which ring was opened by an acidic color developer is recyclized in the presence of a plasticizer such as dibutyl phthalate or dioctyl phthalate.

The formation of a coating film on a thermosensitive recording paper for preventing the permeation of a plasticizer has been proposed [Japanese Pat. Appln. Kokai (Laid-Open) Nos. 128347/79 and 3549/79]. The existing thermosensitive recording paper has unsatisfactory properties such as great deterioration of sensitivity, occurrence of sticking, degrading of printability and the like.

As a result of intensitve studies made on improvement in said disadvantages of the thermosensitive recording paper prepared by the above-mentioned process (3), the present inventors have obtained a thermosensitive recording paper having good printing quality, reduced deterioration of sensitivity, and improved chemical resistance without causing residues and sticking.

The present invention consists in a chemically resistant thermosensitive recording paper, consisting of (a) a dye precursor and (b) a color developer capable of coloring said dye precursor on heating as principal constituent elements, characterized in that one type of overcoat layer selected from the group consisting of alginates, alumina sol, colloidal silica and a mixture of alumina sol with colloidal silica is provided on the topmost layer thereof.

The overcoat layer of an alginate is provided by overcoating the paper with an aqueous solution of the alginate, and drying the overcoat layer. The thickness of dried overcoat layer of 0.5 μm or more, preferably 3 to 12 μm improves both the chemical resistance and the color developing sensitivity. If the thickness of dried overcoat layer is less than 0.5 μm, the chemical resistance is not enough. If the thickness is more than 12 μm, the color developing sensitivity tends to deteriorate though the chemical resistance is improved. The alginate overcoat layer of the present invention has a great advantage of causing no sticking in the fascimile or printer without degrading the printability.

In case alumina sol and/or colloidal silica overcoat layer is provided, the thickness of dried overcoat layer of 0.2 μm or more, preferably 3 to 12 μm gives a thermosensitive recording paper having good color developing sensitivity and water resistance, slight residues and no sticking as well as good chemical resistance. If the thickness is less than 0.2 μm, the chemical resistance is not enough. If the thickness is more than 12 μm, the color developing sensitivity tends to deteriorate though the chemical resistance is improved. The elimination of sticking and the improvement in water resistance are great advantages offered by the overcoat layer of alumina sol and/or colloidal silica provided according to the present invention.

The present inventors attempted to overcoat the paper with various substances; however, they could not find no other substance than those mentioned above as the substance which satisfies all of the chemical resistance, color developing sensitivity, sticking property and adhesion of residues. The overcoat layer formed by using alumina sol and/or colloidal sol provides excellent water resistance.

The overcoat layer formed by using the alginate gives water resistance somewhat lower than that of the substances described above; however, excellent results are obtained with chemical resistance somewhat higher than that of the above-mentioned substances.

Alginates are high polymeric electrolytes present in brown algae and their molecular weight ranges widely. Such alginates are usable in the present invention regardless of the molecular weight.

Any types of salts such as natural sodium salts; ammonium salts or salts of amines preparable by the post-treatment; and further metallic salts of aluminum, calcium, zinc and the like (these metallic salts insoluble in water are used by forming water-soluble complex salts with ammonia) are effective for the purpose intended.

The present inventors have previously proposed the formation of an overcoat layer consisting of a white pigment and a binder in the Japanese utility model application No. 81570/78. The present invention, however, relates to the overcoating treatment with alumina sol or colloidal silica without using other binders, and is distinguished clearly from said prior application.

Alumina sol and colloidal silica to be used in the present invention are industrially prepared, and the size is 100 mμ (length)×10 mμ (width) on an average for alumina sol and about 10 to 50 mμ (particle diameter) for colloidal silica in general.

Alumina sol and colloidal silica having a pH value of about 2 to 4 are not easily used due to the background fog of the thermosensitive recording paper, and those of pH value about 4 to 11 are fit for practical use. The mixing ratio between alumina sol and colloidal silica used together is optional in the present invention, and various properties of the thermosensitive recording paper vary little with the mixing ratio.

The thermosensitive recording paper before overcoating in the present invention will be described hereafter.

The thermosensitive recording paper to be a base has hitherto been well known, and is obtained by coating a sheet of paper or a synthetic resin film base with a coating layer consisting of a dye precursor, a color developer, an organic or inorganic pigment, a binder, a surfactant, a wax as a melting point depressant, a lubricant, and the like.

Typical examples of the dye precursor include Crystal Violet lactone, 3-indolino-3-p-dimethylaminophenyl-6-dimethylaminophthalide, 3-diethylamino-7-chlorofluoran, 3-diethylamino-7-cyclohexylaminofluoran, 3-diethylamino-5-methyl-7-tert-butylfluoran, 3-diethylamino-6-methyl-7-anilinofluoran, 3-diethylamino-6-methyl-7-p-butylanilinofluoran, 2-(N-phenyl-N-ethyl-)aminofluoran, 3-diethylamino-7-dibenzylaminofluoran, 3-cyclohexylamino-6-chlorofluoran, 3-diethylamino-6-methyl-7-xylidinofluoran, 2-anilino-3-methyl-6-(N-ethyl-p-toluidino)fluoran, 3-pyrrolidino-6-methyl-7-anilinofluoran, 3-pyrrolidino-7-cyclohexylaminofluoran, 3-piperidino-6-methyl-7-toluidinofluoran, 3-pyrrolidino-6-methyl-7-(p-toluidino)fluoran, 3-piperidino-6-methyl-7-anilinofluoran, 3-N-methylcyclohexylamino-6-methyl-7-anilinofluoran, 3-diethylamino-7-(m-trifluoromethylanilino)fluoran and the like. However, they are not limited thereto.

Examples of the color developer to be used in the present invention include 4-phenylphenol, 4-hydroxyacetophenone, 2,2'-dihydroxydiphenyl,2,2'-methylenebis(4-chlorophenol),2,2'-methylenebis(4-methyl-6-tert-butylphenol), 4,4'-isopropylidenebis(2-methylphenol), 4,4'-ethylenebis(2-methylphenol), 1,1'-bis(4-hydroxyphenyl)-cyclohexane, 2,2-bis(4'-hydroxyphenyl)propane, 4,4'-cyclohexylidinebis(2-isopropylphenol), novolak type phenolic resin, 3,5-di-tert-butylsalicylic acid, 3,5-di-α-methylbenzylsalicylic acid, 3-methyl-5-tert-butylsalicylic acid, phthalic acid monoanilide p-ethoxybenzoate, p-benzyloxybenzoic acid and the like. However, they are not limited thereto. Additives such as inorganic and organic pigments or binders for preventing adhesion of residues to the facsimile head, other surfactants and waxes are used for preparing the thermosensitive paper in addition to a dye precursor and a color developer.

Well-known and publicly used additives are employed as the additives. For example, aluminum hydroxide, heavy and light calcium carbonate, zinc oxide, titanium oxide, barium sulfate, silica gel, activated clay, talc, clay, satin white, kaolinite, calcined kaolinite, diatomaceous earth, synthetic kaolinite, polyolefin granules, polystyrene granules, urea-formalin resin granules, and the like are used as the pigments. Casein, styrene-maleic anhydride resin, polyvinyl alcohol, modified polyvinyl alcohol, starch, modified starch, isobutylene-maleic anhydride resin, diisobutylene-maleic anhydride resin, polyacrylamide, modified polyacrylamide, carboxymethylcellulose, methyl vinyl ether-maleic acid copolymer, hydroxyethyl cellulose, hydroxypropyl cellulose, carboxy-modified polyethylene and the like are used as the binders.

Nonionic and anionic types are used as the surfactants, and ampholytic and cationic surfactants are not generally used due to possible aggregation of the coating solution.

Stearamide, palmitamide, oleamide, lauramide, ethylenebisstearamide, methylenebisstearamide, methylolstearamide and paraffin wax as well as higher alcohols and higher resin acids may be used as the waxes.

Typical examples of calcium stearate and zinc stearate may be used as the lubricants.

The present invention will be illustrated in more detail by the following examples.

EXAMPLE 1

| | |
|---|---|
| Solution A | |
| 3-(N—Methylcyclohexylamino)-6-methyl-7-anilinofluoran | 12 g |
| 10 wt. % aqueous solution of polyvinyl alcohol | 18 g |
| Water | 30 g |
| Solution B | |
| 4,4'-Isopropylidenediphenol | 40 g |
| Stearamide | 20 g |
| 10 wt. % aqueous solution of polyvinyl alcohol | 90 g |
| Water | 50 g |

Solutions A and B were ground and dispersed in separate ball mills for 24 hrs respectively.

A coating mixture was prepared by the following formation.

| | |
|---|---|
| Calcium carbonate (manufactured by Shiraishi Industry Co., Ltd., Calcium carbonate PC) | 20 g |
| Solution B | 60 g |
| 10 wt. % aqueous solution of polyvinyl alcohol | 70 g |
| Solution A | 20 g |
| Water | 60 g |

The resultant coating mixture was applied to a sheet of base paper having a basic weight of 48 g/m$^2$ to give a coating weight of 5 g/m$^2$ after drying, and the coated sheet of paper was dried at 60° C. for 1 min to prepare a sheet of thermosensitive recording paper.

The thermosensitive recording paper thus obtained was then overcoated with a 5 wt.% aqueous solution of sodium alginates (trade name: Kelgins RL, LV and MV, manufactured by Kelco Division of Merck & Co. Inc.) having three viscosities to give chemically resistant thermosensitive recording papers having a dried film thickness of 5 μm. The resultant chemically resistant thermosensitive recording paper each was then printed by the facsimile, and one drop each of dioctyl phthalate (DOP), ethylalcohol and benzene was added to observe the change in uncolored and colored parts. For purposes of comparison, the thermosensitive recording papers were overcoated with polyvinyl alcohol (Comparative example 1), oxidized starch (Comparative example 2), polyacrylamide (Comparative example 3), styrene-maleic acid sodium salt resin (Comparative example 4) and carboxymethylcellulose (Comparative example 5), respectively, and the similar tests were carried out.

As shown in Table 1, the paper samples of the present invention were found to cause neither fading of colored parts by DOP nor coloring of uncolored parts by ethyl alcohol or benzene. All papers of the Comparative examples gave different results from the paper of present invention. The colored parts were faded by DOP, and the uncolored parts were colored black by ethyl alcohol or benzene with the colored parts faded by the blurring of images. The sticking state in the facsimile was good only in the paper sample of the present invention, and all the samples of Comparative examples were bad.

TABLE 1

| | Colored parts | | | Uncolored parts | | | |
|---|---|---|---|---|---|---|---|
| | DOP | Ethyl alcohol | Benzene | DOP | Ethyl alcohol | Benzene | Sticking |
| Papers of the present invention Kelgin RL | o | o | o | o | o | o | Good |
| Papers of the present invention Kelgin LV | o | o | o | o | o | o | Good |
| Papers of the present invention Kelgin MV | o | o | o | o | o | o | Good |
| Comparative example 1 | X | Ⓧ | Ⓧ | o | Δ | Δ | Bad |
| Comparative example 2 | X | Ⓧ | Ⓧ | o | Δ | Δ | Bad |
| Comparative example 3 | X | Ⓧ | Ⓧ | o | Δ | Δ | Bad |
| Comparative example 4 | X | Ⓧ | Ⓧ | o | Δ | Δ | Bad |
| Comparative example 5 | X | Ⓧ | Ⓧ | o | Δ | Δ | Bad |

o: No change
Δ: Colored
Ⓧ Faded
X: Faded by the blurring of image parts

EXAMPLE 2

The thermosensitive recording paper of Example 1 was coated with an aqueous solution of sodium alginate (trade name: Kelgin LV) to give a dried film thickness of 0.2 μm to 15 μm, and the relation between the film thickness and the fading of colored parts by DOP (resistance to DOP), coloring of uncolored parts by ethyl alcohol (resistance to ethyl alcohol) and change in color developing sensitivity by the facsimile was analyzed.

At the same time, similar tests were carried out on polyvinyl alcohol (trade name: KL-318, manufactured by Kuraray Co., Ltd.) recognized to have good coat properties for purposes of comparison to give results as shown in Table 2.

Thus, it is better to coat the thermosensitive recording paper with sodium alginate to give a film thickness of 0.5 μm or more, preferably in the range of 3 to 12 μm, for practical use from the standpoint of resistance to DOP and ethyl alcohol and color developing sensitivity. Polyvinyl alcohol used for purposes of comparison caused no sticking in the case of a thin film; however, the resistance to DOP and ethyl alcohol was low. On the other hand, a thick film had no practicality due to sticking, and the permeation of DOP from the stuck part deteriorated the resistance to DOP.

TABLE 2

| Film thickness μm | Sodium alginate (this invention) Coloring density | Resistance to DOP | Resistance to ethyl alcohol | Polyvinyl alcohol (Comparative example) Coloring density | Resistance to DOP | Resistance to ethyl alcohol |
|---|---|---|---|---|---|---|
| 0 | 1.25 | X | X | 1.25 | X | X |
| 0.2 | 1.25 | Δ | Δ | 1.25 | X | X |
| 0.5 | 1.24 | Δ ~ o | Δ ~ o | 1.24 | X | X |
| 1.0 | 1.25 | Δ ~ o | Δ ~ o | 1.22 | X | X |
| 2.0 | 1.25 | Δ ~ o | Δ ~ o | Practically unusable due to sticking | Δ Permeation of DOP from the stuck part (bad) | Δ |
| 3.0 | 1.25 | o | o | | | Δ |
| 5.0 | 1.24 | o | o | | | o |
| 6.0 | 1.25 | o | o | | | o |
| 7.0 | 1.24 | o | o | | | o |
| 8.0 | 1.24 | o | o | | | o |
| 10.0 | 1.23 | o | o | | | o |
| 12.0 | 1.22 | o | o | | | o |
| 13.0 | 1.20 | o | o | | | o |
| 15.0 | 1.18 | o | o | | | o |

EXAMPLE 3

| | |
|---|---|
| Solution A | |
| 3-(N—Methylcyclohexylamino)-6-methyl-7-anilinofluoran | 12 g |
| 10 wt. % aqueous solution of polyvinyl alcohol | 18 g |
| Water | 30 g |
| Solution B | |
| 4,4'-Isopropylidenediphenol | 40 g |
| Stearamide | 20 g |
| 10 wt. % aqueous solution of polyvinyl alcohol | 90 g |
| Water | 50 g |

Solutions A and B were ground and dispersed in separate ball mills for 24 hrs respectively.

A coating mixture was prepared by the following formulation.

| | |
|---|---|
| Calcium carbonate (manufactured by Shiraishi Industry Co., Ltd., Calcium carbonate PC) | 20 g |
| Solution B | 60 g |
| 10 wt. % aqueous solution of polyvinyl alcohol | 70 g |
| Solution A | 20 g |
| Water | 60 g |

The resultant coating mixture was applied to a sheet of base paper having a basic weight of 48 g/m$^2$ to give a coating weight of 5 g/m$^2$ after drying, and the coated sheet of paper was dried at 60° C. for 1 min to prepare a thermosensitive recording paper.

Three sheets of the thermosensitive recording paper thus obtained were then overcoated with alumina sol (manufactured by Nissan Chemical Industries, Ltd., Alumina sol—200), colloidal silica (manufactured by Nissan Chemical Industries, Ltd., Snowtex C) and the mixture of alumina sol (the same as described above) and colloidal silica (manufactured by Nissan Chemical Industries, Ltd., Snowtex O), respectively, to give three sheets of chemically resistant thermosensitive recording papers having a dried film thickness of 5 μm.

The each of resultant thermosensitive recording papers was then printed by the thermosensitive facsimile (Toshiba KB-4800 type, Toshiba Corporation), and one drop of dioctyl phthalate (DOP) was added to the colored part; one drop of ethyl alcohol, to the uncolored part. Thus, the fading of colored part and coloring of the uncolored part were observed.

On the other hand, tests were made on sticking, residues attached to the head, and resistance to water. The resistance to water was determined by dropping water to the colored part, rubbing the part with a finger 10 times, reading the change in image density (indicated by mark → in Table 3) with a Macbeth densitometer, and observing the degree of fading by DOP after redrying (DOP fading). The tests showed the greater effects of the paper of the present invention on the resistance to chemicals and water and reduction in residues and sticking than those of the paper without overcoating (Comparative examples).

TABLE 3

| | Chemical resistance | | Water resistance | | | |
|---|---|---|---|---|---|---|
| | DOP | Ethyl alcohol | Change in density | DOP fading | Sticking | Residues |
| Base thermosensitive recording paper without overcoating (Comparative example) | Faded | Colored | 1.25→0.4 | Faded | Slight | Slight |
| Alumina sol-200 | Not faded | Uncolored | 1.20→1.20 | None | None | None |
| Snowtex C | " | " | 1.22→1.21 | None | None | None |
| Alumina sol-200 ...1 / Snowtex O ...1 | " | " | 1.20→1.20 | None | None | None |
| Alumina sol-200 ...2 / Snowtex O ...1 | " | " | 1.20→1.20 | None | None | None |
| Alumina sol-200 ...1 / Snowtex O ...2 | " | " | 1.22→1.20 | None | None | None |

What is claimed is:

1. A chemically resistant thermosensitive recording paper, consisting of (a) a dye precursor and (b) a color developer capable of coloring said dye precursor on heating as principal consituent elements, characterized in that an alginate overcoat layer is provided as the topmost layer thereof.

2. A chemically resistant thermosensitive recording paper according to claim 1, wherein the thickness of the alginate overcoat layer is 0.5 μm or more.

3. A chemically resistant thermosensitive recording paper according to claim 1, wherein the thickness of the overcoat layer is 3 to 12 μm.

4. A chemically resistant thermosetting recording paper according to claim 1 wherein the alginate is sodium alginate.

* * * * *